US009815303B1

(12) United States Patent
Herrmann et al.

(10) Patent No.: US 9,815,303 B1
(45) Date of Patent: Nov. 14, 2017

(54) VACUUM MEDIA TRANSPORT SYSTEM WITH SHUTTER FOR MULTIPLE MEDIA SIZES

(71) Applicant: Xerox Corporation, Norwalk, CT (US)

(72) Inventors: Douglas K. Herrmann, Webster, NY (US); Jason M. Lefevre, Penfield, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 4 days.

(21) Appl. No.: 15/203,751

(22) Filed: Jul. 6, 2016

(51) Int. Cl.

| | |
|---|---|
| ***B41J 11/00*** | (2006.01) |
| ***B41J 2/01*** | (2006.01) |
| ***B41J 13/08*** | (2006.01) |
| ***B41J 13/00*** | (2006.01) |
| ***B65H 11/00*** | (2006.01) |
| *B65H 3/04* | (2006.01) |
| *B65H 29/24* | (2006.01) |

(52) U.S. Cl.
CPC ..... *B41J 11/0085* (2013.01); *B41J 2/01* (2013.01); *B41J 13/009* (2013.01); *B41J 13/08* (2013.01); *B65H 11/005* (2013.01); *B65H 3/04* (2013.01); *B65H 29/242* (2013.01)

(58) Field of Classification Search
CPC ..... B41J 11/0085; B41J 13/009; B41J 13/08; B41J 2/01; B65H 3/04; B65H 5/224; B65H 2406/411; B65H 2406/361; B65H 29/242; B65H 11/005
See application file for complete search history.

(56) References Cited

U.S. PATENT DOCUMENTS

| | | | | |
|---|---|---|---|---|
| 3,527,166 | A | 9/1970 | Jaffa et al. | |
| 3,889,801 | A | 6/1975 | Boyer | |
| 4,066,249 | A | 1/1978 | Huber et al. | |
| 4,326,656 | A | 4/1982 | Gregory et al. | |
| 4,463,361 | A | 7/1984 | Koumura et al. | |
| 4,479,435 | A | 10/1984 | Takeuchi et al. | |
| 4,819,928 | A | 4/1989 | Osborn et al. | |
| 4,831,419 | A * | 5/1989 | Iaia, Jr. | B65H 5/224 271/197 |
| 4,992,805 | A * | 2/1991 | Yoshizawa | B41J 2/16511 346/104 |
| 5,031,002 | A | 7/1991 | Yaguchi | |
| 5,037,079 | A | 8/1991 | Siegel et al. | |
| 5,124,728 | A | 6/1992 | Denda | |
| 5,139,253 | A | 8/1992 | Bohme et al. | |
| 5,411,251 | A | 5/1995 | Schmid et al. | |

(Continued)

FOREIGN PATENT DOCUMENTS

JP 2007076175 A * 3/2007

*Primary Examiner* — Sharon A Polk
(74) *Attorney, Agent, or Firm* — Maginot Moore & Beck LLP

(57) ABSTRACT

A media transport system includes a belt with a plurality of rows of holes, a vacuum plenum, and a shutter. The belt is positioned over the vacuum plenum carries a plurality of media over the vacuum plenum. A row of holes in the belt includes inter-copy gaps that separate media on the belt and the inter-copy gaps include no holes in the belt. The shutter includes a solid member that prevents a flow of air between the vacuum plenum and a portion of the belt positioned above the first shutter and a first aperture formed through the solid member that is aligned with the row of holes in the belt.

14 Claims, 4 Drawing Sheets

(56) References Cited

U.S. PATENT DOCUMENTS 5,414,491 A 5/1995 Bryant
5,505,124 A 4/1996 Esposito
5,707,056 A 1/1998 Rauen et al.
5,717,446 A 2/1998 Teumer et al.
6,209,867 B1 * 4/2001 Madsen ..... B41J 11/0025 271/183
6,254,092 B1 7/2001 Yraceburu et al.
6,270,074 B1 8/2001 Rasmussen et al.
6,322,265 B1 11/2001 Mindek et al.
6,394,596 B1 5/2002 Wotton et al.
6,406,017 B1 6/2002 Yaneda
6,454,259 B1 9/2002 Madsen et al.
6,497,522 B2 12/2002 Wotton et al.
6,505,030 B1 1/2003 Santiago et al.
6,543,948 B2 4/2003 Beehler et al.
6,571,702 B2 6/2003 Wotton et al.
6,672,720 B2 1/2004 Smith
6,682,238 B2 1/2004 Yraceburu et al.
6,834,949 B2 12/2004 Greive
6,918,582 B2 7/2005 Dobbertin
6,921,163 B2 * 7/2005 Fujioka ..... B41J 3/46 347/101
6,927,841 B2 8/2005 Hinojosa et al.
RE39,441 E 12/2006 Wotton et al.
7,207,558 B2 4/2007 Edinger
7,296,792 B2 11/2007 Kondratuk et al.
7,384,036 B2 6/2008 Kruijt
7,513,499 B2 4/2009 Müller et al.
2002/0067403 A1 6/2002 Smith
2002/0110400 A1 8/2002 Beehler et al.
2005/0156376 A1 * 7/2005 Kondratuk ..... B65H 29/242 271/276
2006/0043666 A1 3/2006 Piccinino, Jr.
2010/0084804 A1 4/2010 Zirilli
2010/0276879 A1 11/2010 Bober
2014/0240423 A1 * 8/2014 Cressman ..... B41J 11/001 347/104
2015/0259144 A1 * 9/2015 Hershfeld ..... B31B 1/88 347/104

* cited by examiner

VACUUM MEDIA TRANSPORT SYSTEM WITH SHUTTER FOR MULTIPLE MEDIA SIZES

TECHNICAL FIELD

This disclosure is directed to printers and, more particularly, to media transport systems for print media in inkjet printers.

BACKGROUND

Inkjet printers form printed images using one or more printheads, each one of which includes an array of inkjet ejectors. A controller in the printer operates the ejectors to form printed images that often include both text and graphics and may be formed using one or more ink colors. Some inkjet printers move print media, such as paper sheets, envelopes, or any other article suitable for receiving printed images, on a belt past one or more printheads to receive the ink drops that form the printed image. Many printers that use belts to transport print media use a vacuum plenum and belts that have holes to generate a suction force through the surface of the belt. Each print medium engages a portion of the holes on the surface of the belt and the suction force holds the print medium to the surface of the belt to prevent the print media from slipping or otherwise moving relative to the surface of the belt as the belt moves through the printer. Holding each print medium in place relative to the surface of the moving belt enables the printer to control the timing of the operation of printheads to ensure that the printheads form printed images in proper locations on each print medium and ensures that the print media do not cause jams or other mechanical issues with the printer. In large-scale printer configurations, the belt often carries multiple print media simultaneously.

One problem with belts that carry print media over a vacuum plenum is that the print media often do not completely cover every hole on the belt. For example, as a belt carries two or more print media, a gap between sheets of consecutive print media can include holes exposed to the vacuum plenum. The relative locations of gaps on the belt often change between print jobs that use print media of different sizes. The suction force of the vacuum plenum draws air through the exposed holes near the edges of the print media, which produces airflow. In regions around the printheads, the airflow can affect the paths of ink drops as the ink drops travel from the printhead to the surface of the print medium, which can reduce the accuracy of drop placement and degrade image quality, particularly near the leading and trailing edges of the print media. For example, FIG. 3 depicts printed images produced by a prior art printer where text printed near a trailing edge of a document exhibits degraded image quality due to the airflow near the printhead. Consequently, improved media transport systems that provide suction force to hold print media in place while reducing or eliminating the negative effects of airflow due to exposed holes near printheads in the printer would be beneficial.

SUMMARY

In one embodiment, a media transport system that reduces the negative effects of airflow through exposed holes around a workstation or print zone has been developed. The media transport system includes a vacuum plenum, a belt positioned over the vacuum plenum, a first shutter positioned between the vacuum plenum and the belt, and a first actuator configured to move the belt over the vacuum plenum in a process direction to enable the belt to carry a plurality of media in the process direction. The belt includes at least one member that forms a surface to carry media, a plurality of rows of holes formed through the at least one member to enable the vacuum plenum to draw air through the plurality of rows of holes, and a first plurality of inter-copy gaps formed in a first row of holes in the plurality of rows of holes, each inter-copy gap in the first plurality of inter-copy gaps includes no holes formed through the at least one member, and the first plurality of inter-copy gaps is arranged at a first predetermined interval along the first row of holes, the first predetermined interval corresponds to a first predetermined size of media that the belt carries in a process direction. The first shutter includes a solid member that prevents a flow of air between the vacuum plenum and a portion of the belt positioned above the first shutter, and a first aperture formed through the solid member, the first aperture being aligned with the first row of holes in the belt to enable the vacuum plenum to draw air through the first row of holes and to prevent the vacuum plenum from drawing air through the first aperture as each inter-copy gap in the plurality of inter-copy gaps moves over the first aperture.

In another embodiment, a printer with a media transport system that reduces the negative effects of airflow through exposed holes near printheads has been developed. The printer includes a media transport system, and a print zone. The media transport system includes a vacuum plenum, a belt positioned over the vacuum plenum, a first shutter positioned between the vacuum plenum and the belt, and a first actuator configured to move the belt over the vacuum plenum in a process direction to enable the belt to carry a plurality of print media in the process direction. The belt includes at least one member that forms a surface to carry print media, a plurality of rows of holes formed through the at least one member to enable the vacuum plenum to draw air through the plurality of rows of holes, and a first plurality of inter-copy gaps formed in a first row of holes in the plurality of rows of holes, each inter-copy gap in the first plurality of inter-copy gaps including no holes formed through the at least one member, and the first plurality of inter-copy gaps being arranged at a first predetermined interval along the first row of holes, the first predetermined interval corresponding to a first predetermined size of print media that the belt carries in a process direction. The first shutter includes a solid member that prevents a flow of air between the vacuum plenum and a portion of the belt positioned above the first shutter and a first aperture formed through the solid member, the first aperture being aligned with the first row of holes in the belt to enable the vacuum plenum to draw air through the first row of holes and to prevent the vacuum plenum from drawing air through the first aperture as each inter-copy gap in the plurality of inter-copy gaps moves over the first aperture. The print zone includes at least one printhead positioned over the belt in a location that is proximate to the first shutter, the printhead being configured to eject ink drops onto a surface of a print medium placed on the belt between a first inter-copy gap and a second inter-copy gap in the first plurality of inter-copy gaps where each inter-copy gap covers the first aperture of the solid member an edge of the print medium moves past the at least one printhead.

BRIEF DESCRIPTION OF THE DRAWINGS

The foregoing aspects and other features of a media transport system and an inkjet printer including the media transport system are explained in the following description, taken in connection with the accompanying drawings.

DETAILED DESCRIPTION

Figure 1A:
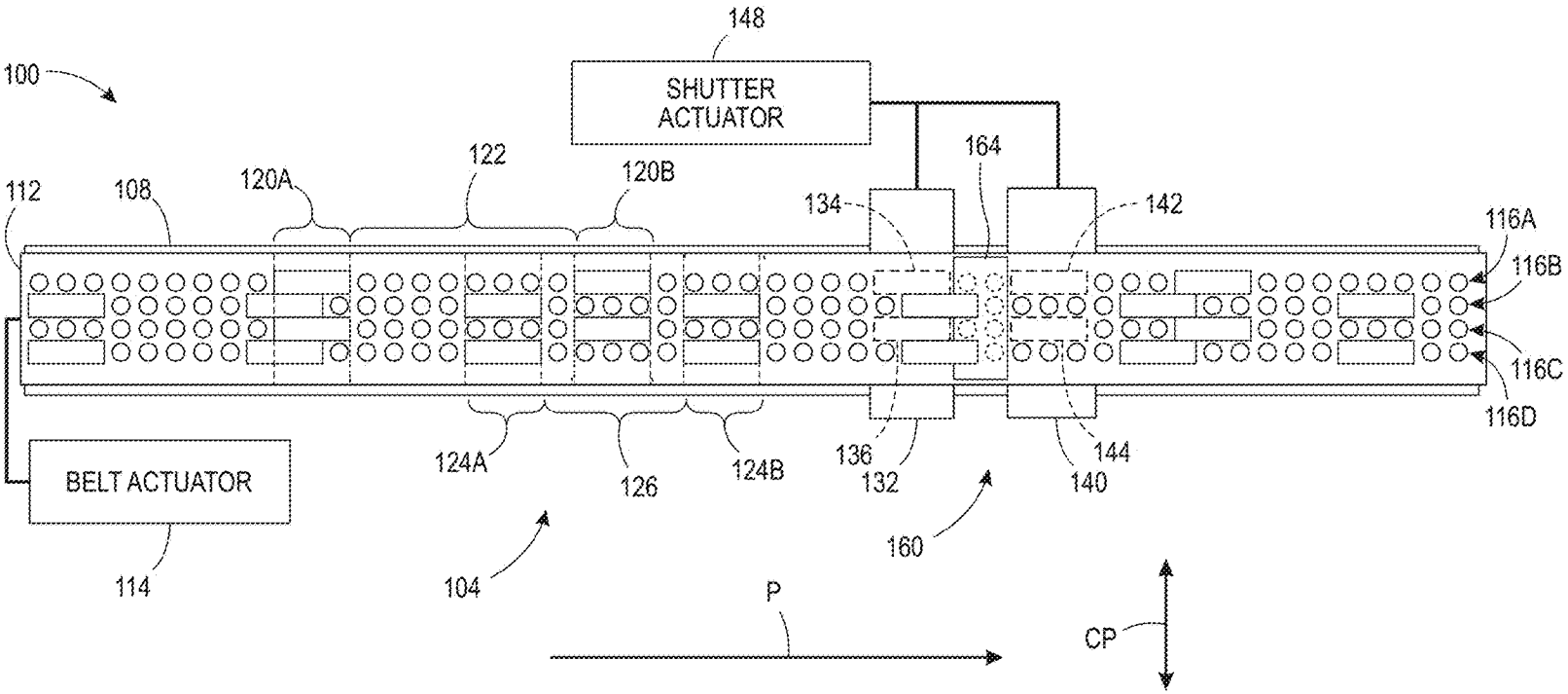
FIG. 1A is a schematic diagram of a media transport system and print zone in an inkjet printer.

For a general understanding of the environment for the device disclosed herein as well as the details for the device, reference is made to the drawings. In the drawings, like reference numerals designate like elements.

As used herein, the word "printer" encompasses any apparatus that produces images with colorants on media, such as digital copiers, bookmaking machines, facsimile machines, multi-function machines, and the like. As used herein, the term "process direction" (P) refers to a direction of movement of print media through the printer including through a print zone including at least one printhead. For example, a media transport system includes a belt that moves in the process direction. The belt has a surface that carries print media along the process direction past at least one printhead in a print zone. The at least one printhead ejects drops of ink to form printed images on each print medium. A location that is "upstream" in the process direction relative to a component in the printer refers to a location that the print media passes prior to reaching the component, such as an upstream location that a print medium passes prior to reaching a printhead or other component in the printer. A location that is "downstream" in the process direction relative to a component in the printer refers to a location that the print media passes after reaching the component, such as a downstream location that a print medium passes after passing a printhead or other component in the printer. As used herein, the term "cross-process" direction (CP) refers to an axis that is perpendicular to the process direction along a surface of the belt and the print media on the surface of the belt.

As used herein, the term "vacuum plenum" refers to an apparatus that includes at least one chamber, a vacuum source, such as an electrical pump or fan system, and at least one opening that is configured to engage one surface of a belt in a media transport system. The vacuum source draws air through holes that are formed in the belt through the chamber and out an exhaust opening. A print medium placed on a surface of the belt opposite the surface that engages the opening to the chamber in the vacuum plenum covers a portion of the holes in the belt. The vacuum generated in the vacuum plenum applies a downward force to the print medium through the holes in the belt that are covered by the print medium.

As used herein, the term "belt" refers to at least one moveable member in a media transport system that has a surface configured to carry print media in the process direction through the printer. The belts described herein include holes arranged in a plurality of rows with each row including holes that are arranged substantially parallel to the process direction and multiple rows of holes are arranged across a width of the belt in the cross-process direction. One side of the belt exposes the holes at least one opening in the vacuum plenum that is described above. On another side of the belt, the holes engage the print media that the belt carries through the printer and the vacuum force through the holes that engage the print media holds the print media in a fixed position relative to the surface of the belt. Examples of belts include, but are not limited to, rubberized endless belts formed from at least one member that optionally include composite fabric layers, segmented belts formed from flexible or rigid members that join together to form the surface of the belt, and any other suitable belt structure.

As used herein, the term "inter-copy gap" refers to predetermined regions of the belt that that lie between print media while the belt carries the print media in the process direction. In one illustrative embodiment, an inter-copy gap of approximately 2.5 cm in length separates adjacent media sheets on the belt, although alternative embodiments use larger or smaller inter-copy gap sizes. The inter-copy gaps repeat at regular intervals along the length of the belt corresponding to the predetermined length of a print medium (e.g., every 210 mm or 297 mm for size A4 paper depending upon the paper being arranged width-wise or length-wise, respectively, on the belt). As described in more detail below, the belt includes no holes in the inter-copy gap locations for a portion of the rows of holes that are formed in the belt. To accommodate multiple print media sizes using a single belt, the belt includes no holes in two or more different rows of holes at different intervals for the inter-copy gaps of different sizes of print media that the belt carries in the media transport system. Additional details about specific embodiments of the belts and the structure of the inter-copy gaps are presented below.

As used herein, the term "shutter" refers to a solid member, such as a polymer or metallic sheet, with at least one aperture formed in the solid member. The aperture is aligned with one row of holes in the plurality of rows of holes formed in the belt corresponding to an inter-copy gap for a predetermined size of print medium that the belt carries during a print job. As described in more detail below, the shutter is positioned between the belt and the opening of the vacuum plenum at a location that is proximate to a printhead in the printer to reduce or eliminate airflow that the vacuum plenum produces in the inter-copy gap regions where the print medium does not cover holes in the belt. In some embodiments, an actuator adjusts the location of the shutter along the cross-process direction to align one or more apertures in the shutter with different sets of rows in the belt. Each set of rows has a different inter-copy gap interval to accommodate a different size of print medium. By moving a shutter to different positions under the belt prior to commencing a print job, the media transport system enables a single belt to accommodate multiple print media sizes. Additionally, the media transport system optionally includes two or more shutters along the process direction.

Figure 1B:
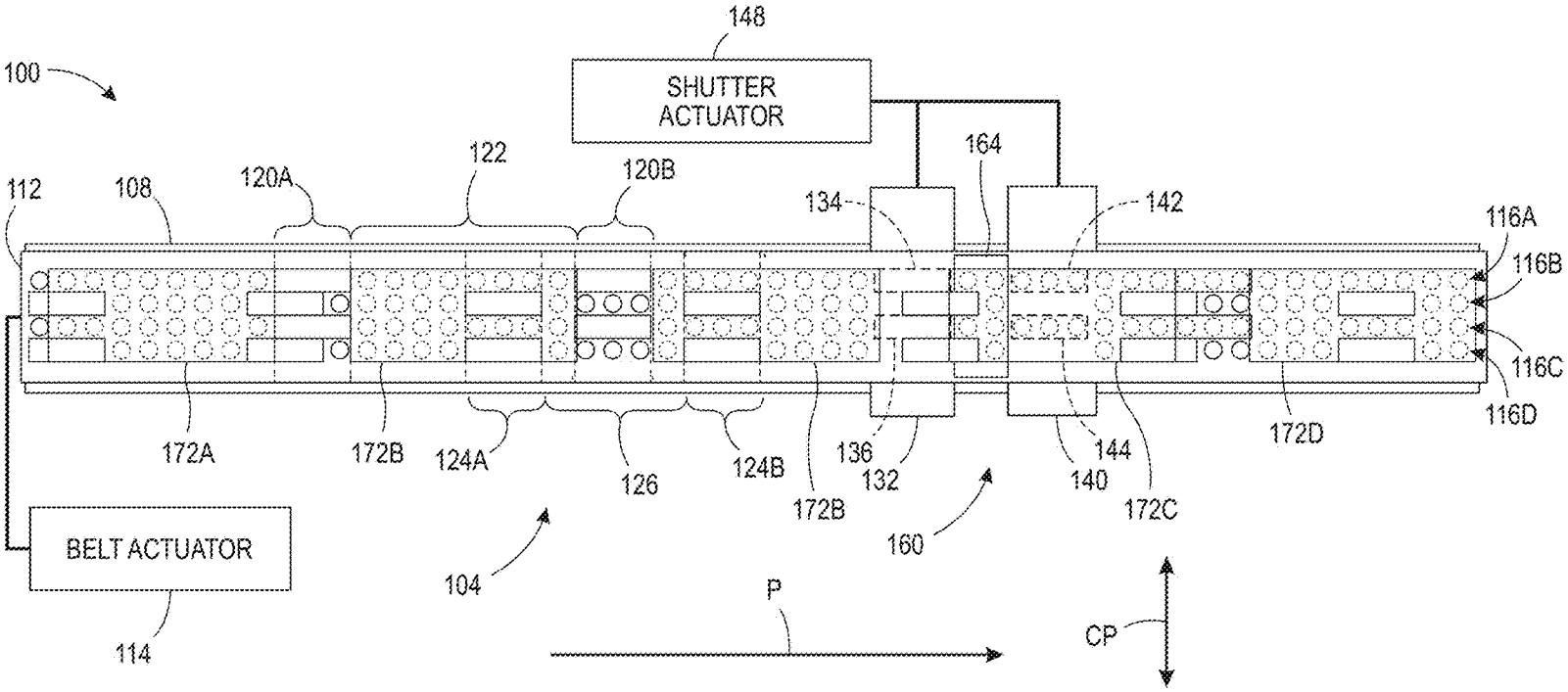
FIG. 1B is a schematic diagram of the inkjet printer of FIG. 1A during a print job in which the media transport system carries a plurality of print media through the printer in a process direction.

FIG. 1A and FIG. 1B are schematic diagrams of an inkjet printer 100 that includes a media transport system 104 and a print zone 160. FIG. 1A is an overhead view of the printer 100 and FIG. 1B depicts the printer 100 during a print job in which the media transport system 104 carries print media sheets through the print zone 160.

The media transport system 104 includes the vacuum plenum 108, belt 112, belt actuator 114, two shutters 132 and 140, and a shutter actuator 148. In the overhead view of FIG. 1, the vacuum plenum 108 is located underneath the belt 112. In FIG. 1A and FIG. 1B, the belt 112 includes four rows of holes 116A, 116B, 116C, and 116D, although alternative embodiments often include a larger number of rows of holes. The pump in the vacuum plenum 108 applies suction to draw air through the holes in each of the rows of holes 116A-116D that are formed in the belt 112. The shutters 132 and 140 are positioned between the lower surface of the belt 112 and the opening of the vacuum plenum 108.

The belt 112 includes the four rows of holes 116A-116D. The belt 112 includes two different sets of inter-copy gaps that enable the belt 112 to accept two different sizes of print media. For example, the rows of holes 116A and 116C are configured for media sheets with a process-direction dimension 122 as depicted in FIGS. 1A and 1B. The belt 112 carries multiple media sheets with inter-copy gaps, such as inter-copy gaps 120A and 120B, separating each media sheet. In the illustrative example of the printer 100, the inter-copy gaps have a process-direction length corresponding to approximately three holes in one of the rows of holes 116A-116D. Thus, the belt 112 includes a plurality of sets of holes with the process-direction dimension 122 for a first predetermined print medium size with each media sheet being separated by the inter-copy gaps, such as the inter-copy gaps 120A and 120B. The belt 112 also accepts a second size of print medium using the rows of holes 116B and 116D. In FIGS. 1A and 1B, the rows of holes 116B and 116D accept media sheets with the process-direction dimension 126 on the belt 112. The rows 116B and 116D include the inter-copy gaps, such as inter-copy gaps 124A and 124B, which separate each print medium having the second size. While the dimensions of the first and second media sheet sizes differ, the sizes of the inter-copy gaps 120A/120B and 124A/124B on the belt 112 are substantially the same. During a print job in the printer 100, the belt actuator 114, which is typically one or more electric motors, rotates one or more rollers to propel the belt 112 in the process direction P at a predetermined velocity.

As depicted in FIG. 1B, sheets of the media sheets also engage the holes in the rows 116B and 116D and cover portions of the inter-copy gaps for the rows 116B and 116D, such as media sheet 172B covering the inter-copy gap 124A. The exposed holes in the belt 112 provided sufficient suction to hold the media sheets in place on the surface of the belt 112. While the drawings illustrate regions of the inter-copy gaps in the belt 112 that do not include holes as solid rectangles, those of skill in the art should recognize that the portions of the inter-copy gaps without holes do not require any additional structural features beyond the basic structure of the belt 112. While FIG. 1A and FIG. 1B depict a belt 112 that is configured to carry two different sizes of media sheet, belts with a different number of rows of holes can carry a larger number of different media sheet sizes. Additionally, while the belt 112 includes two rows of holes for each media sheet size, alternative belts use a different number of rows with inter-copy gaps that do not include holes for each media size.

The shutters 132 and 140 each include two apertures positioned in each shutter to align with the two corresponding rows of holes in the belt 112 for a given print medium size during a print job. For example FIG. 1B depicts a print job using media sheets 172A-172D that have the first predetermined size corresponding to the arrangement of inter-copy gaps in the rows of holes 116A and 116C. In the printer 100, the belt 112 includes two rows of holes for each print medium size. Similarly, the shutters 132 and 140 each include two apertures (apertures 134 and 136 in shutter 132 and apertures 142 and 144 in shutter 140), one aperture for each row of holes corresponding to one media sheet size. The size of each aperture in each shutter is approximately the same as the size of the region in each inter-copy gap region in a row of holes that does not include any holes (e.g., the aperture 134 is approximately the same size as the inter-copy gap 120B in row 116A). Each shutter includes an arrangement of the apertures with the same spacing in the cross-process direction CP as the arrangement of different rows of holes for the different media sizes, such as the alternating rows 116A/116C and 116B/116D for the belt 112 in the printer 100. The shutter actuator 148, which is an electric motor or other suitable electromechanical actuator in the printer 100, moves the shutters 132 and 140 to an appropriate position in the cross-process direction CP to align the apertures 134 and 136 in shutter 132 with the rows of holes 116A and 116C, respectively. The shutter actuator 148 similarly moves the shutter 140 to align the apertures 142 and 144 with the rows of holes 116A and 116C, respectively. In another printer embodiment, one or more shutters are moved to the appropriate position for a predetermined print medium size manually prior to commencing a print job.

In the printer 100, the shutter 132 is located upstream in the cross-process direction P from the printhead 164 in the print zone 160 and the shutter 140 is located downstream from the printhead 164. While the printer 100 includes two shutters that are located on either side of the printhead 164 in the process direction P, an alternative configuration includes a single shutter on only one side of the printhead 164 or a single shutter in a location that is directly under the printhead 164. In particular, printer configurations in which the size of the inter-copy gap in the process direction P is approximately the same size or larger than the process-direction dimension of the inkjet array in one or more printheads may employ the single shutter positioned directly under the printhead.

The print zone 160 includes a single printhead 164. The printhead 164 is positioned over the surface of the belt 112 to enable the printhead 164 to form printed images on the surfaces of print media that the belt 112 carries in the process direction P through the print zone 160. The printhead 164 includes an array of inkjets that eject drops of ink onto the surface of a print medium in the print zone 160. While FIG. 1A and FIG. 1B depict a single printhead 164 for illustrative purposes, the media transport system 104 depicted in FIG. 1A and FIG. 1B is also suitable for use with more complex print zones that include arrays of multiple printheads in a single location or at different locations along the process direction P. In particular, one or more shutters similar to the shutters 132 and 140 are located proximate to the printheads along the process direction P in a similar manner to the configurations of FIG. 1A and FIG. 1B in printer embodiments that include additional printheads in the print zone.

FIG. 1B depicts operation of the printer 100 during a print job. As mentioned above, one issue with prior art media transport systems that employ a vacuum plenum similar to the vacuum plenum 108 is that the exposed holes in the belt proximate to a printhead, such as the printhead 164, produce an airflow that affects the flight paths of ink drops ejected from the printhead. The shutters 132 and 140 in the printer 100 along with the structure of the belt 112 reduce or eliminate the presence of exposed holes in the belt 112 that could produce airflow proximate to the printhead 164. Additionally, the shutters 132 and 140 enable some holes in the belt 112 to be exposed to the underside of each print medium that passes the printhead 164 to ensure that the print medium remains securely affixed to the belt 112.

FIG. 1B depicts the printer 100 with the media transport system 104 moving the print media sheets 172A-172D in the process direction P on the surface of the belt 112. In FIG. 1B, the dashed circles indicate holes in the belt 112 that engage the underside of a media sheet and the solid circles indicate exposed holes that freely draw air from around the printer 100 into the vacuum plenum 108. Holes that lie underneath the media sheets 172A-172D form a seal with the media sheets and do not produce unwanted airflow near the printhead 164. As described in more detail below, the combination of the structure of the inter-copy gaps in the belt 112 and the shutters 132 and 140 reduce or eliminate the airflow due to exposed holes within the inter-copy gap regions of the belt 112.

In FIG. 1B, the printhead 164 is located over a media sheet 172C as the trailing edge of the media sheet 172C is about to pass the printhead 164. In FIG. 1B, the inter-copy gap that is upstream of the sheet 172C is positioned over the shutter 132. The solid portion of the member in the shutter 132 blocks all of the holes in the inter-copy gap in the rows 116B and 116D to prevent any of those holes from being exposed near the printhead 164. The apertures 132 and 136 in the shutter 132 are aligned with the portions of the inter-gap region in rows 116A and 116C that do not include any holes, and therefore little or no air passes through the apertures 134 and 136 as the inter-copy gap region of the belt 112 moves past the shutter 132. Thus, when an inter-copy gap region of the belt 112 moves over a shutter, the shutter and the regions of the belt 112 that do not include holes effectively prevent airflow into the vacuum plenum 108. The shutters 132 and 140 are positioned proximate to the printhead 164 to block holes and prevent the vacuum plenum 108 from drawing air through the holes in the belt 112 that are near the printhead 164 as each print medium approaches the printhead 164 and passes the printhead 164. In FIG. 1B, the shutter 140 blocks airflow downstream of the leading edge of a print medium as the leading edge of the print medium approaches the printhead 164. Additionally, the shutter 132 blocks airflow upstream of the trailing edge of each print medium as the print medium passes the printhead 164, which is the situation depicted in FIG. 1B.

As mentioned above, the shutters 132 and 140 block the holes in the belt 112 in regions proximate to the printhead 164 to improve the accuracy of ink drop placement from the printhead 164 onto the surfaces of print media in the print zone 160. Each shutter, however, also includes one or more apertures to enable a portion of the holes in the belt 112 to remain in communication with the vacuum plenum 108 as a print medium passes over each shutter. The apertures enable the media transport system 104 to maintain at least partial suction on the media sheets to secure the media sheets to the surface of the belt 112 even as the media sheets pass over the shutters 132 and 140. For example, in FIG. 1B each of the apertures 142 and 144 in the shutter 140 exposes holes in the rows 116A and 116C to the lower surface of the media sheet 172C. The remaining portion of the solid member in the shutter 140 blocks the other holes in the rows 116B and 116D underneath the shutter 140. However, at least a portion of the holes in the belt 112 remain engaged to the media sheet 172C to enable the vacuum plenum 108 to apply suction to the portion of the media sheet 172C that is over the shutter 140. Since the media sheet 172C engages the exposed holes in the belt 112 through the apertures 142 and 144, little or no spurious airflow occurs in the region of the print zone 160 proximate to the printhead 164.

Figure 2:
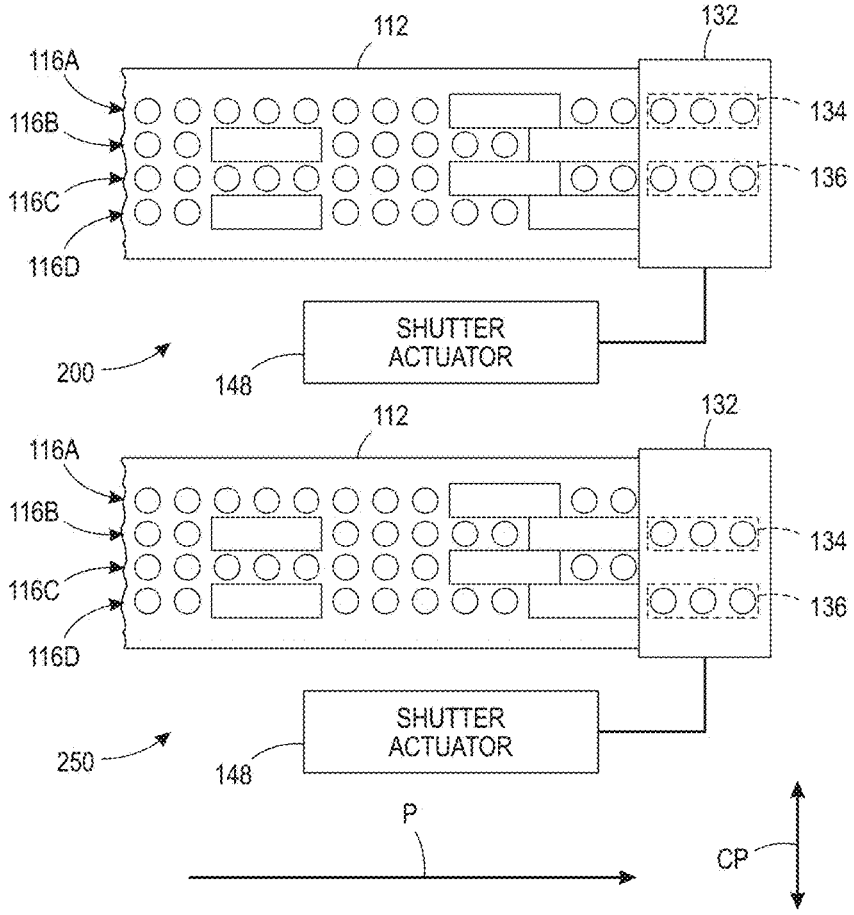
FIG. 2 is a detailed view of a portion of the media transport system in the printer of FIG. 1A and FIG. 1B with a shutter in the media transport being located at two different positions to enable print jobs using two different print media sizes.
Figure 3:
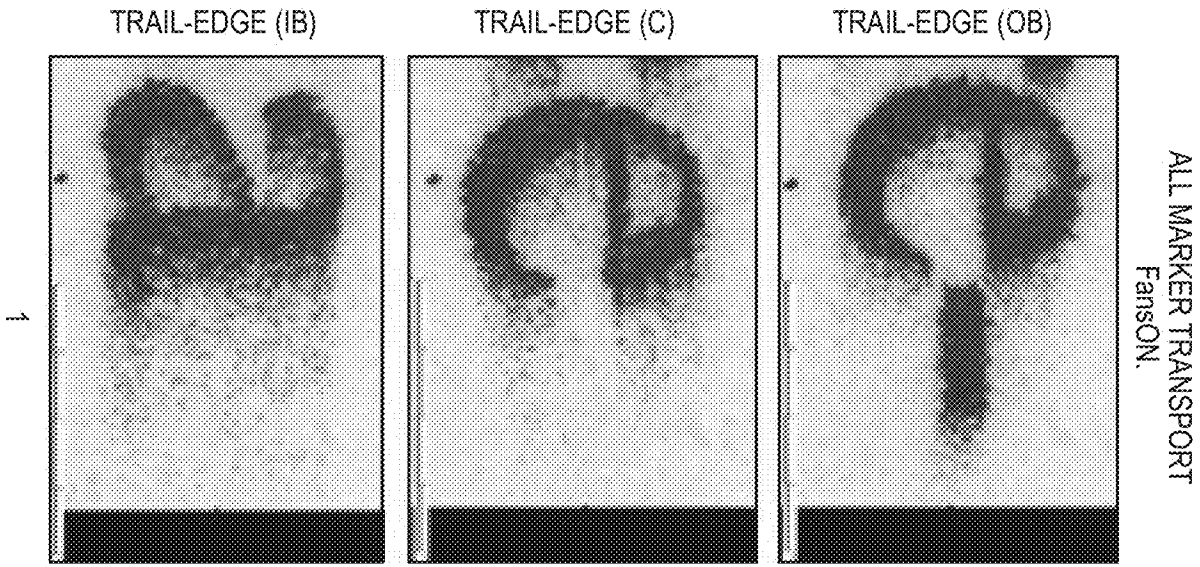
FIG. 3 PRIOR ART
FIG. 3 is a depiction of printed text produced by a prior art printer. The text includes degraded image quality due to the effects of airflow near the printhead from exposed holes in a belt and vacuum plenum that draws air through the holes proximate to the printhead.

FIG. 2 is a detailed view of a portion of the components in the media transport system 104 of FIG. 1 that depicts two configurations 200 and 250 of a shutter (shutter 132) to enable printing of two different print media sizes. In the configuration 200, the apertures 134 and 136 in the shutter 132 are aligned with rows of holes 116A and 116C, respectively, in the belt 112. The configuration 200 enables the printer 100 to perform a print job using a first media sheet size as depicted above for media sheets with a process-direction dimension 122 in FIG. 1A and FIG. 1B. In the configuration 250, the apertures 134 and 136 in the shutter 132 are aligned with rows of holes 116B and 116D, respectively, in the belt 112. The configuration 250 enables the printer 100 to perform a print job using a second media sheet size as depicted above for media sheets with a process-direction dimension 126 in FIG. 1A and FIG. 1B. During operation of the printer 100, the shutter actuator 148 repositions the shutter 132 to align the apertures 134 and 136 with either set of rows 116A/116C or 116B/116D prior to commencing a print job based on the size of the print media used during each print job. The shutter actuator 148 also repositions the shutter 140 in the same manner as the shutter 132 depicted in FIG. 2. Alternative belt and shutter embodiments can accommodate more than two sizes of media sheet and optionally include a different number of apertures for belts that use a different number of rows for each print medium size.

The various embodiments of the media transport system 104 are described with reference to the printer 100. However, those of skill in the art will recognize that the media transport system 104 can be used in a wide range of industrial settings that utilize a moving belt transport system. Various manufacturing processes benefit from reducing or eliminating unwanted airflow through a plenum in a region of the belt around a workstation, which is analogous to the print zone 160 depicted above in FIG. 1. The media transport system 104 can of course transport media other than traditional paper or other print media used in printers. A non-limiting example of an industrial embodiment for the media transport system includes a transport system for silicon substrate media past one or more processing stations during manufacture of microelectronic or micro-electromechanical devices. The structures of the belt and shutters described above reduce airflow around high-precision instruments in a workstation that processes each silicon substrate.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A media transport system comprising:

a vacuum plenum;

a belt positioned over the vacuum plenum, the belt comprising:

at least one member that forms a surface to carry media;

a plurality of rows of holes formed through the at least one member to enable the vacuum plenum to draw air through the plurality of rows of holes; and a first plurality of inter-copy gaps formed in a first row of holes in the plurality of rows of holes, each inter-copy gap in the first plurality of inter-copy gaps includes no holes formed through the at least one member, and the first plurality of inter-copy gaps is arranged at a first predetermined interval along the first row of holes, the first predetermined interval corresponds to a first predetermined size of media that the belt carries in a process direction;

a first shutter positioned between the vacuum plenum and the belt, the first shutter comprising:

a solid member that prevents a flow of air between the vacuum plenum and a portion of the belt positioned above the first shutter; and a first aperture formed through the solid member, the first aperture being aligned with the first row of holes in the belt to enable the vacuum plenum to draw air through the first row of holes and to prevent the vacuum plenum from drawing air through the first aperture as each inter-copy gap in the plurality of inter-copy gaps moves over the first aperture; and a first actuator configured to move the belt over the vacuum plenum in a process direction to enable the belt to carry a plurality of media in the process direction.

2. The media transport system of claim 1, the belt and the first shutter further comprising:

a second plurality of inter-copy gaps formed in a second row of holes in the plurality of rows of holes, each inter-copy gap in the second plurality of inter-copy gaps includes no holes formed through the at least one member, and the second plurality of inter-copy gaps is arranged at a second predetermined interval along the second row of holes, the second predetermined interval corresponds to a second predetermined size of media that the belt carries in a process direction; and the first shutter is configured to move along a cross-process direction to align the first aperture with the second row of holes to enable the vacuum plenum to draw air through the second row of holes and to prevent the vacuum plenum from drawing air through the first aperture as each inter-copy gap in the second plurality of inter-copy gaps moves over the first aperture.

3. The media transport system of claim 2 further comprising:

a second actuator operatively connected to the first shutter and configured to move the first aperture in the first shutter into alignment with the first row of holes in the belt prior to a print job using media of the first predetermined size and to move the first aperture in the first shutter into alignment with the second row of holes in the belt prior to another print job using media of the second predetermined size.

4. The media transport system of claim 1 wherein the first aperture in the first shutter has a size and shape that corresponds to a size and shape of each inter-copy gap in the first plurality of inter-copy gaps in the first row of holes.

5. The printer of claim 1, the belt further comprising:

a second plurality of inter-copy gaps formed in a second row of holes in the plurality of rows of holes, each inter-copy gap in the second plurality of inter-copy gaps including no holes formed through the at least one member, and the second plurality of inter-copy gaps being arranged at the first predetermined interval along the second row of holes; and the first shutter further comprising:

a second aperture formed through the solid member with the first aperture being aligned with the first row of holes in the belt and the second aperture being aligned with the second row of holes in the belt to enable the vacuum plenum to draw air through the first row of holes and the second row of holes and to prevent the vacuum plenum from drawing air through the first aperture or the second aperture as each inter-copy gap in the first plurality of inter-copy gaps moves over the first aperture and each inter-copy gap in the second plurality of inter-copy gaps moves over the second aperture.

6. A printer comprising:

a media transport system comprising:

a vacuum plenum;

a belt positioned over the vacuum plenum, the belt comprising:

at least one member that forms a surface to carry print media;

a plurality of rows of holes formed through the at least one member to enable the vacuum plenum to draw air through the plurality of rows of holes; and a first plurality of inter-copy gaps formed in a first row of holes in the plurality of rows of holes, each inter-copy gap in the first plurality of inter-copy gaps including no holes formed through the at least one member, and the first plurality of inter-copy gaps being arranged at a first predetermined interval along the first row of holes, the first predetermined interval corresponding to a first predetermined size of print media that the belt carries in a process direction;

a first shutter positioned between the vacuum plenum and the belt, the first shutter comprising:

a solid member that prevents a flow of air between the vacuum plenum and a portion of the belt positioned above the first shutter; and a first aperture formed through the solid member, the first aperture being aligned with the first row of holes in the belt to enable the vacuum plenum to draw air through the first row of holes and to prevent the vacuum plenum from drawing air through the first aperture as each inter-copy gap in the plurality of inter-copy gaps moves over the first aperture; and a first actuator configured to move the belt over the vacuum plenum in a process direction to enable the belt to carry a plurality of print media in the process direction; and a print zone comprising:

at least one printhead positioned over the belt in a location that is proximate to the first shutter, the printhead being configured to eject ink drops onto a surface of a print medium placed on the belt between a first inter-copy gap and a second inter-copy gap in the first plurality of inter-copy gaps where each inter-copy gap covers the first aperture of the solid member as an edge of the print medium moves past the at least one printhead.

7. The printer of claim 6, the belt and the first shutter further comprising:

a second plurality of inter-copy gaps formed in a second row of holes in the plurality of rows of holes, each inter-copy gap in the second plurality of inter-copy gaps including no holes formed through the at least one member, and the second plurality of inter-copy gaps being arranged at a second predetermined interval along the second row of holes, the second predetermined interval corresponding to a second predetermined size of print media that the belt carries in a process direction; and the first shutter being moveable along a cross-process direction to align the first aperture with the second row of holes to enable the vacuum plenum to draw air through the second row of holes and to prevent the vacuum plenum from drawing air through the first aperture as each inter-copy gap in the second plurality of inter-copy gaps moves over the first aperture.

8. The printer of claim 7, the media transport system further comprising:

a second actuator operatively connected to the first shutter and configured to move the first aperture in the first shutter into alignment with the first row of holes in the belt prior to a print job using print media of the first predetermined size and to move the first aperture in the first shutter into alignment with the second row of holes in the belt prior to another print job using print media of the second predetermined size.

9. The printer of claim 6 wherein the first aperture in the first shutter has a size and shape that corresponds to a size and shape of each inter-copy gap in the first plurality of inter-copy gaps in the first row of holes.

10. The printer of claim 6, the belt further comprising:

a second plurality of inter-copy gaps formed in a second row of holes in the plurality of rows of holes, each inter-copy gap in the second plurality of inter-copy gaps including no holes formed through the at least one member, and the second plurality of inter-copy gaps being arranged at the first predetermined interval along the second row of holes; and the first shutter further comprising:

a second aperture formed through the solid member with the first aperture being aligned with the first row of holes in the belt and the second aperture being aligned with the second row of holes in the belt to enable the vacuum plenum to draw air through the first row of holes and the second row of holes and to prevent the vacuum plenum from drawing air through the first aperture or the second aperture as each inter-copy gap in the first plurality of inter-copy gaps moves over the first aperture and each inter-copy gap in the second plurality of inter-copy gaps moves over the second aperture.

11. The printer of claim 6, the first shutter being located under the at least one printhead in the print zone.

12. The printer of claim 6, the first shutter being located upstream in the process direction from the at least one printhead in the print zone.

13. The printer of claim 6, the first shutter being located downstream in the process direction from the at least one printhead in the print zone.

14. The printer of claim 6, the media transport system further comprising:

a second shutter positioned between the vacuum plenum and the belt, the second shutter being located upstream in the process direction from the at least one printhead in the print zone, the second shutter comprising:

a solid member that prevents a flow of air between the vacuum plenum and a portion of the belt positioned above the second shutter; and a second aperture formed through the solid member, the second aperture being aligned with the first row of holes in the belt to enable the vacuum plenum to draw air through the first row of holes and to prevent the vacuum plenum from drawing air through the second aperture as each inter-copy gap in the plurality of inter-copy gaps moves over the second aperture.

* * * * *